United States Patent [19]

Griffiths

[11] 4,433,455

[45] Feb. 28, 1984

[54] CLEANING WASTE FROM BENEATH MACHINERY

[76] Inventor: George E. Griffiths, 19 Yew Tree Ave., Northowram;Halifax, West Yorkshire, England

[21] Appl. No.: 323,229

[22] Filed: Nov. 20, 1981

[30] Foreign Application Priority Data

Nov. 27, 1980 [GB] United Kingdom ..... 8038151

[51] Int. Cl.[3] ..... D01G 15/82

[52] U.S. Cl. ..... 19/107

[58] Field of Search ..... 19/200, 107

[56] References Cited

U.S. PATENT DOCUMENTS

| | | | |
|---|---|---|---|
| 3,150,415 | 9/1964 | Reiterer | 19/107 |
| 3,374,118 | 3/1968 | Seress | 19/107 X |
| 3,997,936 | 12/1976 | Smith et al. | 19/107 X |
| 4,057,877 | 11/1977 | Gunter | 19/107 |
| 4,079,483 | 3/1978 | Hicks | 19/107 |
| 4,092,764 | 6/1978 | Thomas et al. | 19/107 |
| 4,224,718 | 9/1980 | Hicks | 19/107 |
| 4,245,444 | 1/1981 | Hicks | 19/107 X |

FOREIGN PATENT DOCUMENTS

| | | | |
|---|---|---|---|
| 474578 | 8/1969 | Switzerland | 19/107 |
| 1148518 | 4/1969 | United Kingdom | 19/107 |

*Primary Examiner*—Louis Rimrodt

*Attorney, Agent, or Firm*—Brooks & Kushman

[57] ABSTRACT

Apparatus for removing waste from below machinery, for example a carding engine (1), a receiving member (3) covers the area beneath the machinery and suction means (5) extends across the full width of the receiving member at one end thereof. Guide means (9) is positioned adjacent to the other end of the receiving member and extends the full width thereof. A traveller (11) is mounted for movement along the guide means and carries a nozzle (13) directed towards the receiving member. The traveller can be reciprocated along the guide means with compressed air supplied to the nozzle during each movement to direct waste matter from the receiving member into the suction means.

4 Claims, 6 Drawing Figures

CLEANING WASTE FROM BENEATH MACHINERY

The present invention relates to the cleaning of waste from beneath machinery, in particular, though not exclusively, from beneath carding machines used in textile industries.

In the cleaning of waste from beneath machinery, in particular textile machinery, it has been conventional to use an elongated air nozzle or a series of fixed air nozzles extending across the width of, and below, the machinery at one end thereof. Compressed air from the nozzle or nozzles is directed across a waste-collecting plate below the machinery, and the air, together with any waste carried thereby, is collected in a plenum chamber at the opposite end of the machinery, and sucked to a collector by a vacuum system.

The cleaning achieved by this type of system has often been inadequate, as the delivered air pressure is dissipated by delivery of that air across the full width of the machinery. The resultant air velocity is thus not high enough to dislodge and convey all waste, particularly waste that is of a sticky nature as is often found in carding.

Many attempts have been made to solve this problem and effect adequate cleaning in this environment. One proposal has been to provide a plurality of fixed nozzles spaced across the width of the region below machinery, and in some cases in a plurality of rows spaced along the length of the region, each nozzle delivering a high velocity blast of air in timed sequence. The complexity and expense of timing equipment, and the expense of a plurality of nozzles is a major drawback of this system.

Another proposal has been the use of moving belts in the region below the machinery, the belts being positioned to collect waste on their upper surfaces and driven to move the waste to a collecting area. This arrangement is cumbersome, presents problems in belt disposition and control and is again expensive.

Still other proposals have relied on complex arrangements of movable flaps and baffles to concentrate waste in particular areas and then to restrict these areas so that cleaning may be effected by a concentrated blast of compressed air. Again, this leads to cumbersome and expensive installations.

The invention seeks to provide adequate cleaning in an extremely simple and economic manner.

According to the present invention there is provided apparatus for removing waste from below machinery comprising one or more receiving members substantially covering the area beneath the machinery, suction means extending across the full width of the receiving members adjacent to one end thereof, guide means positioned adjacent to the other end of the receiving members and extending the full width thereof, a traveller mounted for movement along the guide means and carrying at least one nozzle directed towards the receiving members, means for reciprocating the traveller along the or each guide means and means for supplying compressed air to the nozzle during such movement.

The traveller may carry more than one nozzle, and the or each nozzle may incorporate a venturi arrangement for entraining additional ambient air and thus delivering a greater volume of air.

The reciprocating means may be hydraulic, pneumatic, electrical or mechanical, or a combination thereof.

Apparatus in accordance with the present invention provides a waste cleaning system which by movement of the traveller the full width of the waste receiving members at required intervals periodically subjects each part of the receiving members to a jet of compressed air that may readily be delivered at such intensity as to dislodge all or the greater part of the waste deposited thereon. The dislodged waste matter is then directed into the suction means, for example a plenum chamber, by the combined forces of the jet of compressed air and of the suction. A system in accordance with the present invention combines the advantage of high efficiency with quite exceptional economy and simplicity when compared with systems currently in use.

Embodiments of the present invention will now be described by way of example only, and with reference to the accompanying drawings, in which.

Figure 1:
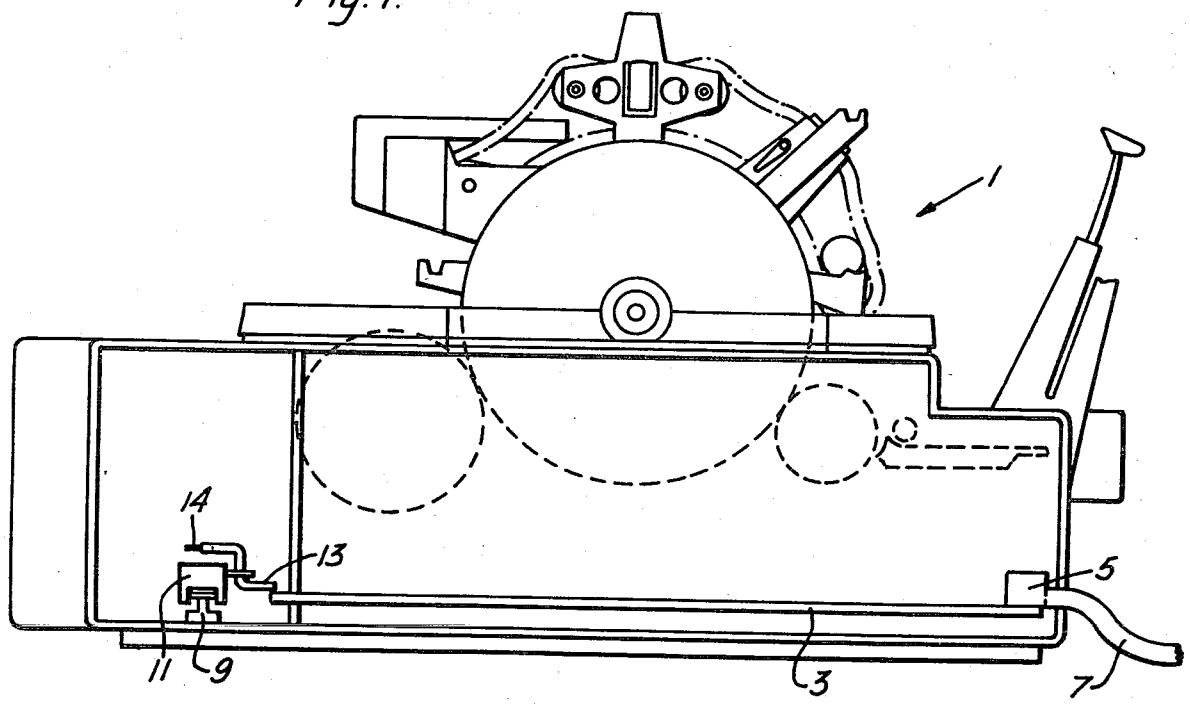
FIG. 1 is a schematic side elevation of a section through a carding machine having a waste removal system according to the present invention.
Figure 2:
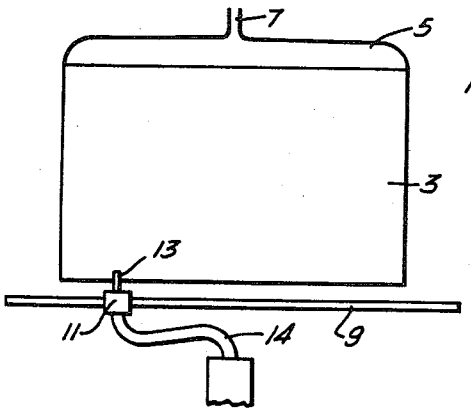
FIG. 2 is a schematic plan view of the waste removal system of FIG. 1.

Referring to FIGS. 1 and 2, these show schematically the location of a waste removal system in accordance with the invention beneath a carding engine 1. The system comprises a waste collection plate 3 positioned beneath the carding engine 1, and extending below substantially the whole area of the working parts of said carding engine, so as to collect the greater part of the waste produced during operation thereof. Extending the full width of the plate 3 at one end of the carding engine is a plenum chamber 5 connected by a vacuum line 7 to an exhaust.

At the opposite end of the plate 3 is provided a rail or other form of guide 9 extending the full width of the plate 3. A traveller or carrier 11 is mounted on the guide 9 for reciprocation along the guide, and carries a single air nozzle 13 directed towards and over the upper surface of the plate 3.

A supply of compressed air is connected by a flexible hose 14 to the traveller 11 and thence to nozzle 13.

In use, means (not shown in FIGS. 1 and 2) which may be hydraulic, pneumatic, electrical, mechanical or a combination thereof, are provided for moving the traveller through a full outward and return stroke along the length of the guide, at predetermined intervals. During such movement of the traveller, compressed air is fed thereto and the result is that a high pressure restricted jet of air travels across the width of the plate 3, and back again, so directing waste from the plate into the plenum chamber 5. The very high pressure that can be delivered from a single nozzle 13 is extremely effective in cleaning the plate 3.

Figure 3:
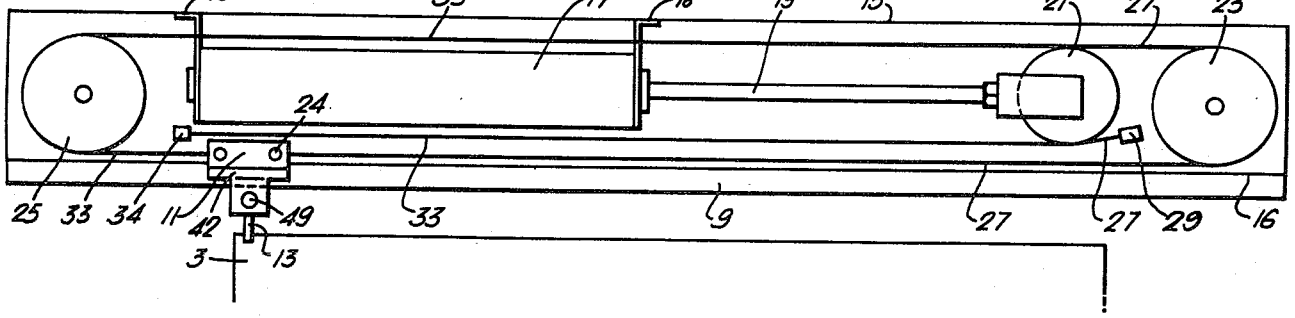
FIG. 3 is an enlarged plan view of a particular form of waste removal system such as that of FIG. 1.
Figure 4:
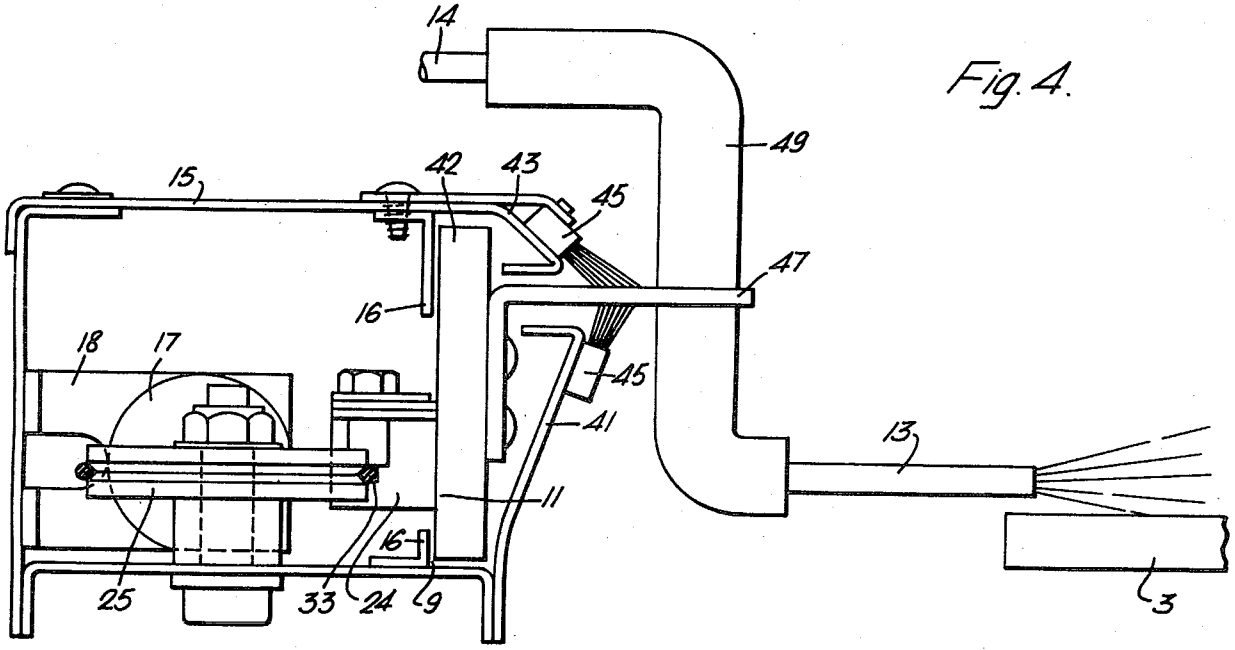
FIG. 4 is an end elevation of the system of FIG. 3, with part removed for clarity.

Referring now to FIGS. 3 and 4, the carrier, guide and drive apparatus of an embodiment of a waste removal system in accordance with the present invention will now be described in greater detail.

The apparatus is housed in an elongated housing 15, which may be a single box or series of boxes of substantially rectangular cross-section, extending the full width of the carding engine and secured to the framework of that engine. A front portion of the housing is divided from the remainder by partition members 16, the front portion defining a guide 9 in which the main body of the carrier 11 is received and can move. Within the main portion of the housing is a pneumatic or hydraulic cylinder 17, attached to the housing by fixing brackets 18. Connected to a piston within the cylinder 17 is an elongate arm 19, having at its free end a clevis on which is rotatably mounted a cylinder pulley 21 having two spaced grooves around the circumference thereof. At each end of the housing there is rotatably mounted a pulley 23, 25.

A cord 27 is taken from an anchorage 29 between the pulley 23 and the cylinder pulley 21, around one groove of the cylinder pulley 21, thence around the pulley 23 and finally secured to a portion of the carrier that projects from the main body thereof between the partition members 16. The pulleys are so aligned that the straight sections of cord 27 are mutually parallel, and also parallel to guide 9.

Secured to the opposite end of the portion 24 of the carrier from the end of cord 27, is the end of a similar cord 33. Cord 33 extends from carrier 11 around pulley 25 and around the second groove in the cylinder pulley 21, and is then fixed to an anchorage 34 that may be positioned between pulley 25 and the end of the cylinder 17 nearest thereto. Again, the straight sections of cord 33 are arranged to lie mutually parallel, and also parallel with guide 9.

In use, when it is desired to traverse carrier 11 along guide means 9, hydraulic fluid (in a hydraulic system) or compressed air (in a pneumatic system) is injected into, or exhausted from, cylinder 17 by control means (not shown). This has the effect of advancing or retracting the piston and thus transmitting movement to the cylinder pulley 21 by the arm 19.

Movement of the cylinder pulley 21 towards the cylinder 17 has the effect of shortening the portion of the cord 27 lying between the carrier 11 and the pulley 23, so pulling the carrier 11 along the guide 9 towards the pulley 23. At the same time, the movement of the cylinder pulley 21 towards the cylinder 17 allows the portion of the cord 33 lying between the carrier 11 and the pulley 25 to be lengthened, to allow the movement of the carrier 11 towards pulley 23.

When the cylinder pulley 21 is moved away from the cylinder 17, the exact reverse occurs, so that the carrier 11 is pulled along the guide towards the pulley 25.

It will be appreciated that the dimensions and relative positions of the apparatus in the system should be such as to allow the carrier 11 to traverse across substantially the full width of the waste collection plate beneath the carding engine or other machinery. In particular the stroke of the piston should be half the length of the required path of movement of the carrier 11.

When fitted below machinery, the system should be protected as fully as possible from waste produced by the machinery, and this protection is given by the housing 15. As already stated, a front portion of the housing acts as guide 9 for the main body 42 of the sectioned block. Attached to and projecting perpendicularly from the body 42 of the carrier 11 is a support bracket 47 for an air hose 49. At the end of the air hose 49 is the nozzle 13, directed across the surface of the waste collection plate 3. Attached to the other end of the air hose 49 is a flexible air hose 14 leading to the exterior of the machinery, and to the air supply.

In order to accommodate and to support the body 42 and the bracket 47 of the carrier 11, the wall of the housing 15 has, in its side nearest the plate 3, a longitudinal groove through which the bracket 47 projects. The two sections 41 and 43 of the wall, divided by the groove, are angled outwardly towards the waste collection plate 3, and then folded back towards the inside of the housing 15, so as to lie parallel to the projecting surface of the bracket 47. Secured to the angled surfaces of the wall sections 41 and 43 are brushes 45, the bristles of said brushes 45 being similarly angled outwardly towards the waste collection plate 3, and being in contact with the upper and lower surfaces of the support bracket 47. The provision of such brushes, extending the full length of the groove, allows free movement of the bracket 47 longitudinally along the groove in the guide means 9, whilst preventing the access of waste and dirt into the guide means 9.

Figure 5:
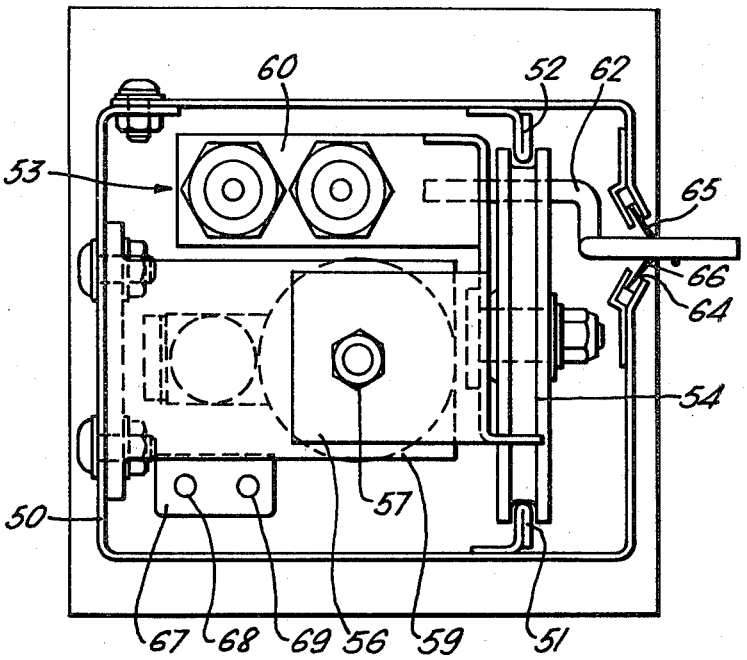
FIGS. 5 and 6 are views similar to FIGS. 3 and 4 respectively of a second particular embodiment of waste removal system.
Figure 6:
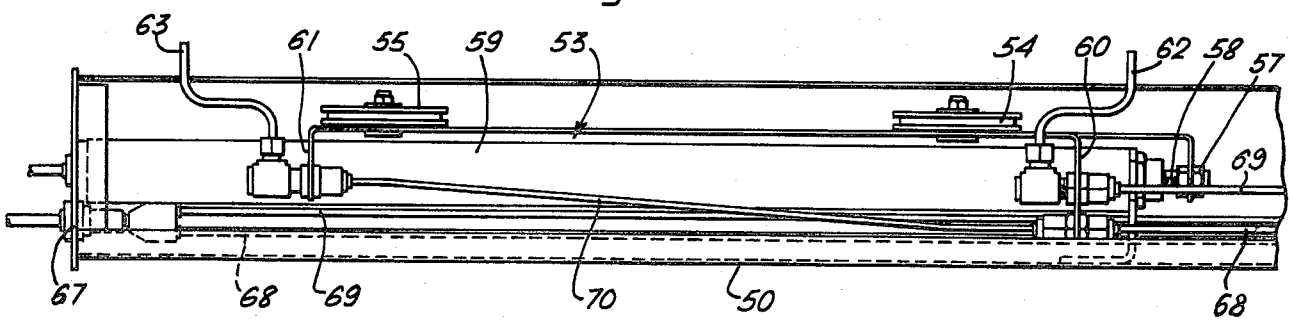

Referring now to FIGS. 5 and 6 these show an alternative arrangement in which a fabricated housing 50 extends the full width of a receiving plate beneath a carding engine. The housing includes two internal guides 51 and 52, and a traveller or carrier 53 is mounted within the housing and is carried by two wheels 54, 55 engaging the guides 51, 52. An end plate 56 of the carrier is secured by nuts 57 to the end of a piston rod 58 associated with a piston movable within a double-acting cylinder 59 secured within the housing.

Brackets 60 and 61 forming part of the traveller carry respective nozzles 62, 63, each of which is formed to extend through a slot 64 in the front of the housing. The slot is closed by a flexible seal in the form of two brushes 65, 66 extending the full length of the slot, each nozzle projecting between the brushes. A supply of compressed air is connected to a fitting 67 which divides the supply onto two flexible air lines 68, 69, which extend to couplings on the bracket 60. One line is there connected directly to the nozzle 62, the other line is connected to a further pipe 70 extending to the bracket 61 and is there coupled to the nozzle 63. A supply of compressed air is also connected to the cylinder 59.

In operation it is seen that as the piston rod is extended the traveller moves from the left to right as shown in FIG. 6. If, simultaneously, compressed air is supplied to the nozzles 62 and 63 then an air blast from nozzle 62 will travel across the width of the right-hand section of the receiving member, and an air blast from the nozzle 63 will travel across the left-hand part of the receiving member. Waste will thus be dislodged from the full width of the member. When the traveller reaches its limit of travel it may either rest there for a timed delay before being driven back to the left, or may immediately make a return stroke to the left and wait in that limit position until initiation of a further traverse.

Rather than use a simple nozzle or nozzles, the or each nozzle may be designed on the venturi principle, such that the compressed air entrains additional ambient air into the nozzle and directs the resulting increased volume of air over the receiving member.

The components of the apparatus described may be of any suitable material, preferably materials that will not be adversely affected by the waste matter produced by the operation of the machinery under which the apparatus is placed.

I claim:

1. Apparatus for removing waste from below machinery, the apparatus comprising one or more receiving members substantially covering the area beneath the machinery, suction means extending across the full width of the receiving members adjacent to one end thereof, guide means positioned adjacent to the other end of the receiving members and extending the full width thereof, a traveller mounted for movement along the guide means and carrying at least one nozzle directed towards the receiving members, means for reciprocating the traveller along the guide means and means for supplying compressed air to the or each nozzle during such movement.

2. Apparatus according to claim 1 in which two nozzles are carried by a common traveller.

3. Apparatus according to claim 1 in which the traveller is movable within an enclosed housing extending the full width of the receiving members, and the or each nozzle, or a carrier for the or each nozzle, extends through a slot extending the length of a front portion of the housing.

4. Apparatus according to claim 3 in which flexible sealing means through which the or each carrier or nozzle projects extend the full length of the slot.

* * * * *